US006945531B2

(12) United States Patent
Perobelli et al.

(10) Patent No.: US 6,945,531 B2
(45) Date of Patent: Sep. 20, 2005

(54) DEVICE FOR THE SEPARATION OF A SERIES OF PRODUCTS THAT ARE SUPERPOSED IN A SCALE-LIKE FASHION

(75) Inventors: Aldo Perobelli, Paderno Dugnano (IT); Giorgio Pessina, Cusano Milanino (IT)

(73) Assignee: ERCA Di Erminio Maria Traversi & C. S.a.s., Caronno Pertusella (IT)

( * ) Notice: Subject to any disclaimer, the term of this patent is extended or adjusted under 35 U.S.C. 154(b) by 244 days.

(21) Appl. No.: 10/275,638

(22) PCT Filed: May 14, 2001

(86) PCT No.: PCT/IT01/00232

§ 371 (c)(1),
(2), (4) Date: Nov. 7, 2002

(87) PCT Pub. No.: WO01/87750

PCT Pub. Date: Nov. 22, 2001

(65) Prior Publication Data

US 2003/0116476 A1 Jun. 26, 2003

(51) Int. Cl.[7] ..... B65H 5/34

(52) U.S. Cl. ..... 271/270; 271/69; 271/182; 271/202

(58) Field of Search ..... 271/270, 69, 182, 271/198, 202

(56) References Cited

U.S. PATENT DOCUMENTS

| | | | | | |
|---|---|---|---|---|---|
| 4,076,114 | A | * | 2/1978 | Tokuno | 198/418.9 |
| 4,265,443 | A | * | 5/1981 | Berthelot | 271/182 |
| 4,948,114 | A | * | 8/1990 | Bowman et al. | 271/202 |
| 5,158,278 | A | * | 10/1992 | Auf der Mauer | 271/270 |
| 5,160,132 | A | * | 11/1992 | Hanada | 271/258.01 |

FOREIGN PATENT DOCUMENTS

| | | |
|---|---|---|
| EP | 0 557 255 A | 8/1993 |
| GB | 1 268 895 | 3/1972 |
| GB | 2 074 990 | 11/1981 |

* cited by examiner

*Primary Examiner*—David H. Bollinger
(74) *Attorney, Agent, or Firm*—Dann, Dorfman, Herrell and Skillman, P.C.; Henry H. Skillman

(57) ABSTRACT

A device for achieving the separation or extension of the scale of products in a conveyance in superposed copies in which means are provided that are capable of increasing the speed of the belts (12, 17) conveying the separated or extended scale relative to the speed of the upstream belt (11) of the device for the conveyance of the scale before the separation or extension.

7 Claims, 3 Drawing Sheets

DEVICE FOR THE SEPARATION OF A SERIES OF PRODUCTS THAT ARE SUPERPOSED IN A SCALE-LIKE FASHION

The object of the present invention is a device for the separation or extension of a series of products that are transported in a scale-like fashion, that is superposed to one another in a herring-bone fashion, in order to create groups of products that are spaced apart from one another in order to ease the stacking operations of the same on suitable machines provided for that purpose, or to divert the flow of the scale-like transported product for the intended processing operations.

The applied technique has consisted up to now in stopping the scale-like transported products by means of a barrier, such that the upper products are retained by the barrier and accumulate against the same. The lower products, in contact with the belt or belts, slide under the barrier, thereby creating the gap between succeeding groups of products.

Based on the previous explanation, it is evident that the separation between groups of products is the greater, the longer the time during which the barrier remains lowered on the scale-fashion conveyor is. Conversely, the longer the barrier remains lowered on the scale-fashion conveyor, the greater is the amount of products that are accumulated against the barrier, thereby making the stacking operations or subsequent processing operations more difficult, and in many cases even impossible, to be carried out because of the excessive accumulation of the product against the barrier. The greater the thickness of the scale-fashion transported product and its speed, the greater is said processing difficulty. In order to possibly carry out the product processing or stacking, the production rate is lowered.

The object of the present invention is to solve the above-described problem in a reliable way, such that the production speed and the thickness of the scale-fashion transported product have no influence. The scale-fashion transported products can be: signatures, paper or paperboard sheets, folded carton boxes, and the like. By the term 'signature' as it is used in the present application we mean an assembly of folded sheets that are called four-page, eight-page, 16-page, 32-page folder, and so on, according to the number of sheet faces a signature comprises.

Figure 1A:
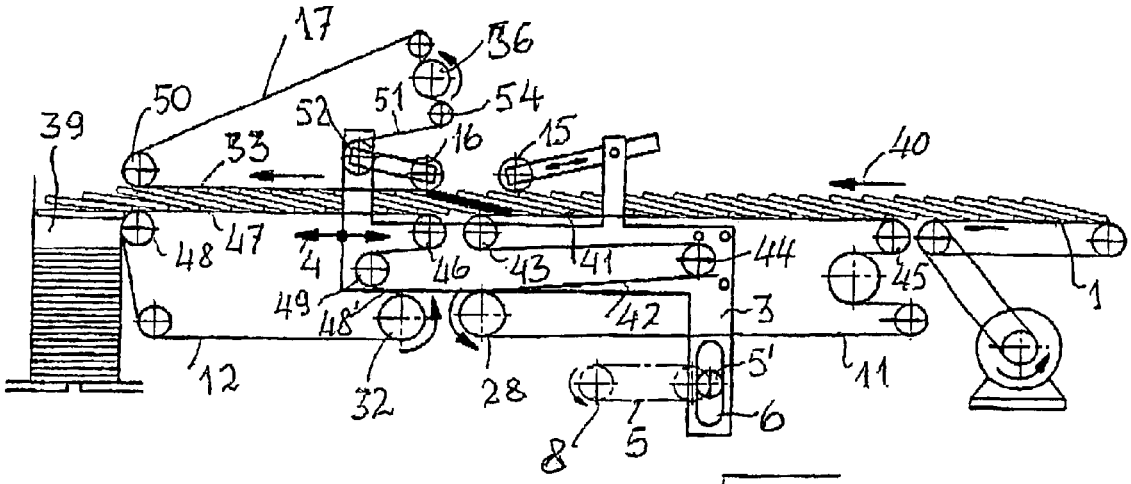
Figure 1B:
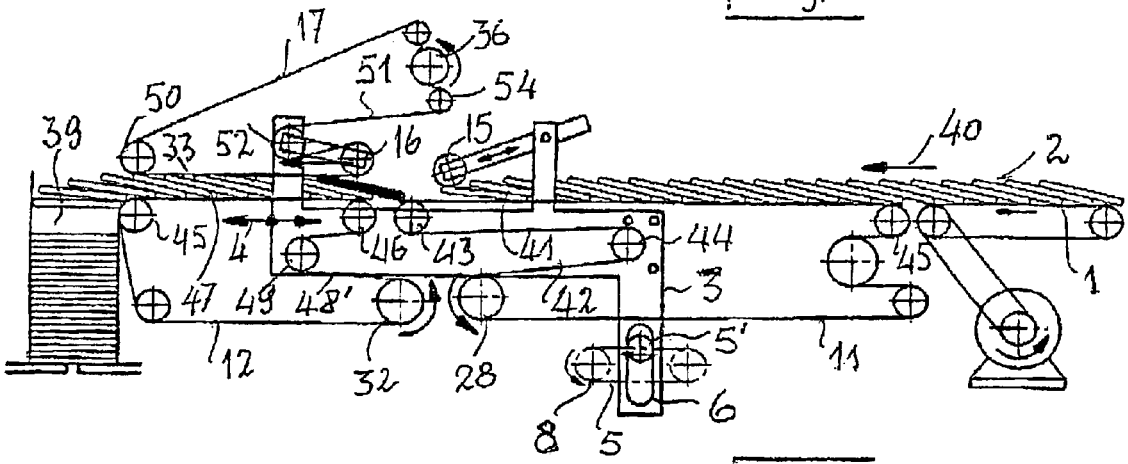
Figure 2:
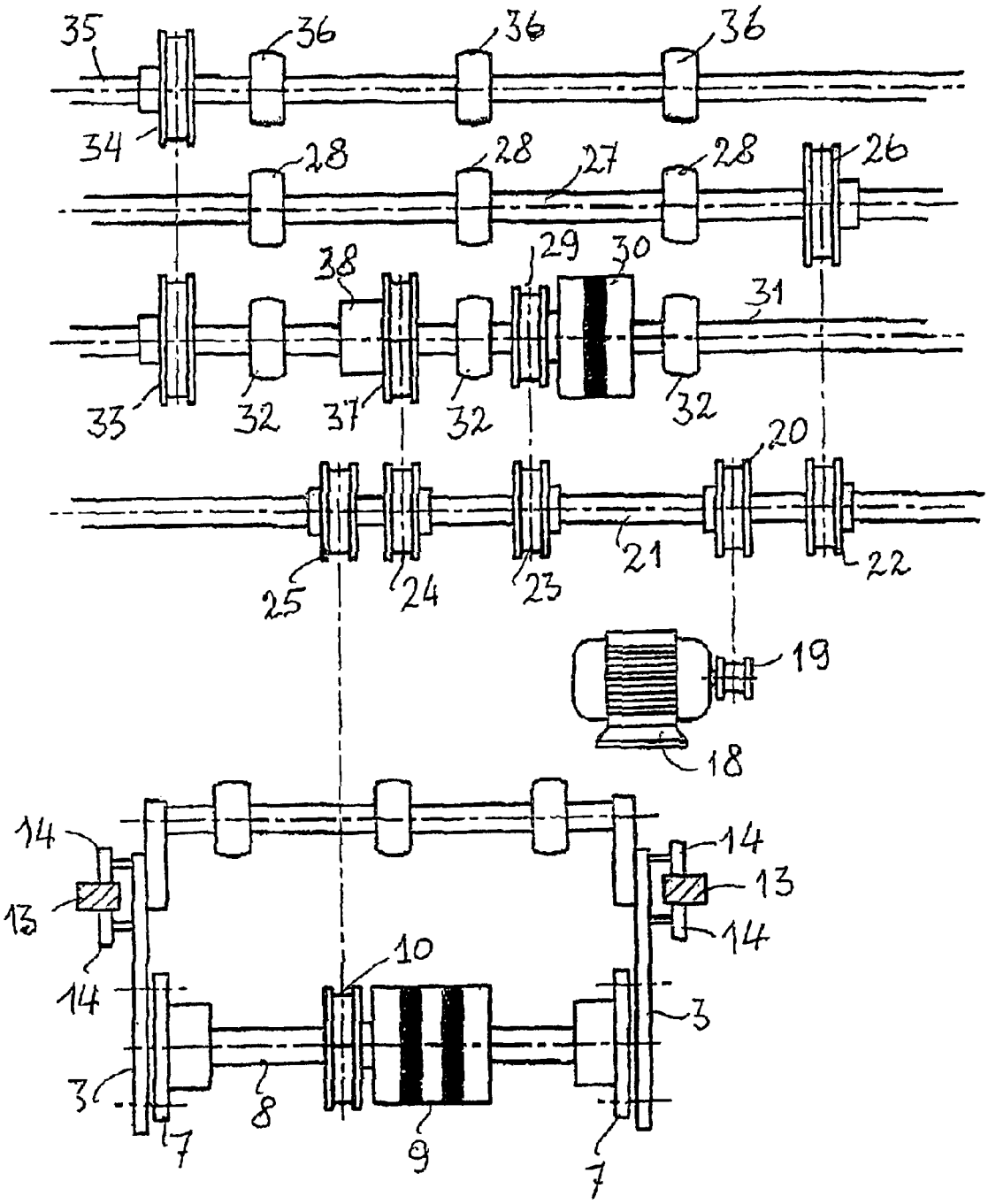
Figure 3:
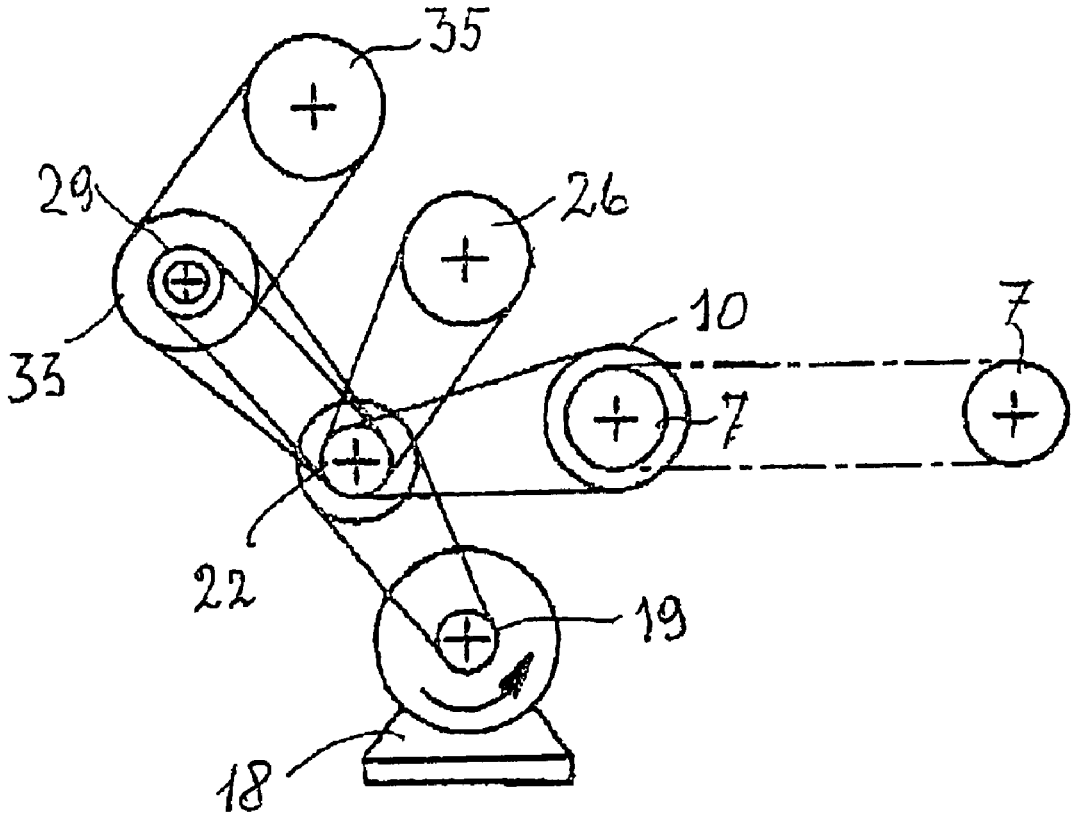

The features, advantages and the solution of the technical problem the present invention is based on will become evident upon reading the detailed description herein below of a preferred but non exclusive embodiment, said embodiment being illustrated in a non-limiting manner in the accompanying drawing, in which:

FIGS. 1*a,* 1*b,* 1*c* represent the side-view of the subject device, in three different positions;

FIG. 2 schematically represents a plan view of the way the device is driven; and FIG. 3 represents a side-view of the driving means of FIG. 2.

Referring now to FIGS. 1*a,* 1*b,* 1*c,* the device comprises the conveyor 1 on which material 2 is arranged in a scale-like fashion, said material being herein after referred to as products for convenience of description.

From the conveyor 1 the products are passed onto the movable carriage 3 that is driven in a reciprocating manner as shown by means of arrow 4. The reciprocating motion of carriage 3 is implemented by means of toothed belts or chains 5, on which a pawl 5' is integrally arranged, said pawl 5' sliding along the slot that is formed in the prismatic piece 6, which is integral with the carriage 3. The reciprocating motion of carriage 3 can be accomplished with equivalent means, such as: connecting rod and crank, air or hydraulic piston, rack device. Pawl 5' can be substituted by equivalent means.

The sprocket wheels 7 driving the chains 5 are integral with shaft 8 that is connected with a brake-clutch device 9, which in turn is connected with pulley 10 (FIG. 2). Part of the path of belts 11 and 12 extends over the movable carriage 3 that runs on the rails 13, which are fixed on the machine structure. Rollers 14 that slide on the rails 13 are integral with carriage 3.

Carriage 3 is provided with rollers 15 that can be adjusted according to the format of product 2 with the point of contact of roller 16 and belts 12. On the roller 16 the upper conveyor belts 17 are wound the path of which partly extends over the movable carriage 3.

Motor 18 carries a pulley 19 that drives, through a belt, pulley 20, said pulley 20 being integrally connected with shaft 21 on which the pulleys 22, 23, 24, 25 are arranged.

Pulley 22 is connected through a belt with pulley 26, said pulley 26 being integrally connected with shaft 27 on which the driving pulleys 28 for belts 11 are fixed.

Pulley 23 through a belt drives pulley 29 that is integrally connected with a friction clutch 30. When engaged, the friction clutch 30 is connected to shaft 31 on which the pulleys 32 are fixed, said pulleys 32 driving the belts 12. A pulley 33 is integrally connected with shaft 31 and through a belt drives pulley 34, said pulley 34 being integrally connected with shaft 35 on which the driving pulleys 36 for belts 17 are fixed.

Pulley 25 is connected through a belt with pulley 10.

Pulley 24 is connected through a belt with pulley 37 that is integrally connected with a ratchet 38, said ratchet 38 engaging shaft 31 that can increase its rotational speed when it is engaged by the motion of clutch 30.

Wheels 15 can be adjusted according to the length of product 2 such that distance of wheels 16 and wheels 15 is equal to or greater than the dimension of the product that is being processed. After the path of belts 12 and 17, the products can be stacked in a stacking station 39, or channelled to the subsequent processing.

Herein after the cycle for the separation of scale-like arranged signatures is described.

The products 2 coming from a scale-fashion conveyor 1, the flow direction of which is indicated by arrow 40, run on belts 11 and belts 12, said belts being driven by motor 18. When an agreement for clutch 30 to be engaged is output, said clutch driving belts 12 though the pulleys 32 and belts 17 through the pulleys 36, the speed of said belts is increased, this being due to the different ratio between pulleys 23 and 29, the friction clutch being at the same time actuated and the brake of the brake-clutch group 9 being disengaged, which brake-clutch group drives the chains 5 that move the carriage 3. The speeds of carriage 3 and belts 11 are almost the same. Products 2 that are under the rollers 15 and the belts 11 are retained, whilst the carriage 3 is advanced, as the relative speed between the carriage and the belts 11 is almost the same.

The products 2 that are beyond the point of contact of rollers with the belts 11 start slipping from under the scale as a consequence of the increased speed of belts 12 and 17 that pinch the products 2, thereby accelerating them.

The speed increase of belts 12 and 17 is caused by the engagement of friction clutch 30 that is integrally connected with pulley 29, the rotation ratio of pair of pulleys 29–30 being greater than the rotation ratio of pair of pulleys 24–37 that transmits the motion to belts 12 and 17 before the friction clutch 30 is engaged. The ratchet, which is integrally connected with the drive of pulley 37, allows the rotational speed of shaft 31 to be increased, such speed increase always being in the running direction.

Figure 1C:
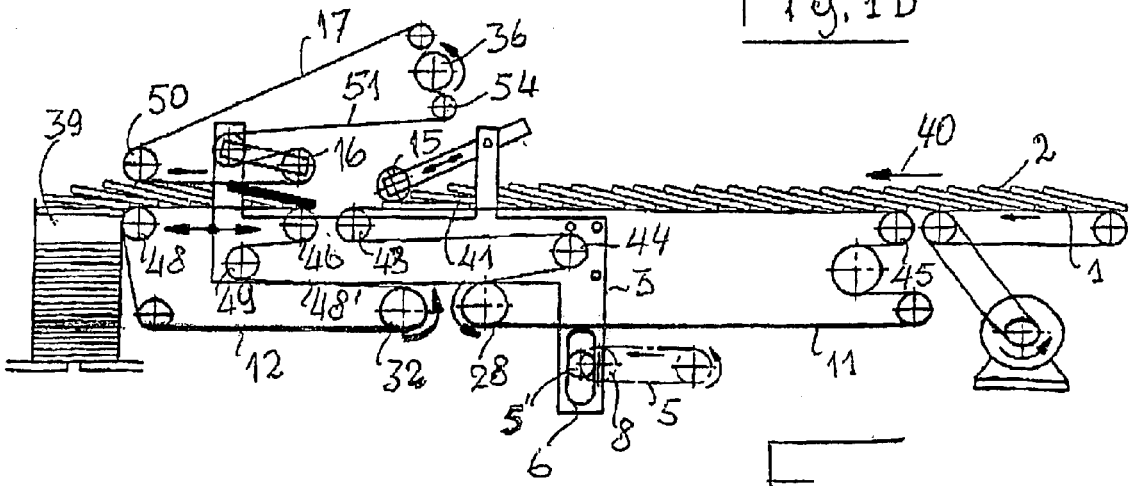

When carriage is in the fully advanced position (FIG. 1*c*), the separation of the scale with no superposition of the products will have been achieved. When carriage 3 goes back again to its departure position (FIG. 1*a*), owing to the movement of the chain cooperating with the prismatic piece 3 that is integral with carriage 3, the brake of the brake-friction clutch group 9 is actuated, while the clutch of the brake-friction clutch group 9 is disengaged. Whereas, friction-clutch 30 is preferably disengaged when carriage 3 is in the fully advanced position (FIG. 1*c*), however in any such place of the path of carriage 3, that the separation or extension of the scale is achieved in a position in which there not an excessive superposition of the scale downwards from the opening or separation point of the scale.

When carriage 3 is in the starting position, a new scale separation operation can be carried out.

The length of belts 11 during the motion of carriage 3 remains unchanged because the section 41, which is in contact with the products that are arranged in a scale-like fashion and extend between roll 43, said roll 43 being fixedly attached to the movable carriage 3, and roll 45, said roll 45 being fixedly attached to the non represented structure, becomes longer. On the contrary, the section 42 of the belts 11, reaching from roll 28, said roll 28 being fixedly attached to the structure, and roll 44, said roll 44 being fixedly attached to the movable carriage 3, becomes shooter in the same amount as section 41 becomes longer.

The length of belts 12 also remains unchanged because during the movement of carriage 3 the section 47 of the belts that is in contact with the scale in lower section and is comprised between roll 48, said roll 48 being fixedly attached to the structure, and roll 46, said roll 46 being fixedly attached to the movable carriage 3, becomes shorter. On the contrary, the section 48' of the belts 12, reaching from roll 32, said roll 32 being fixedly attached to the structure, to roll 49, said roll 49 being fixedly attached to the movable carriage 3, becomes longer in the same amount as section 47 becomes shorter.

The length of belts the 17 that are in contact with the upper part of the scale remains unchanged in the course of the displacement of carriage 3 because section 53, reaching from roll 50, said roll 50 being fixedly attached to the structure, to roll 16, said roll 16 being fixedly attached to the movable carriage 3, becomes shorter during the displacement. On tie contrary, the section 51 of the belts 17, reaching from roll 52, said roll 52 being fixedly attached to the movable carriage 3, and roll 54, said roll 54 being fixedly attached to the structure of the machine, becomes longer in the same amount as section 53 becomes shorter.

The opposite of what has been described concerning belts 11, 12, 17 occurs when the carriage from its filly advanced position returns to the cycle-start position.

The friction-clutch 30, the brake-clutch 9, the ratchet 38 can be substituted with equivalent mechanical members, such as: electronic-control motors, hydraulic or pneumatic motors, air pistons or oil pistons, provided they are suitable to achieve the same effects as the present invention.

While the scale separation or extension cycle is carried out, the speed of motor 18 driving the belts 11, 12, 17 and the movable carriage 3 is preferably reduced relative to the speed of motor 54 driving the conveyor 1 in order not to have an excessive speed of carriage 3 and a high increase of the speed of belts 12 and 17 operating the separation or extension of the scale. This involves a reduction of the pitch of scale in that moment, when the products arranged in a scale-like fashion are transferred from conveyor 1 to belts 11. Such a reduction of the pitch of the scale has no effect on the subsequent processing steps.

The scale separation cycle can also be carried out by reducing the speed of belts 11 relative to belts 12 and 17.

What is claimed is:

1. A device for obtaining a separation or extension of the scale of products, consisting of signatures, paper or paperboard sheets, folded boxes and the like, comprising a scale-fashion conveyor of the products in copies that are superposed in a scale-like fashion; a movable carriage; a first roller for the retention of the scale; a conveyor of the products composed of first and second belts, characterized in that the device comprises a second roller fixed on said carriage; means for adjusting the position of the first roller according to the length of the products and the position of the second roller; a third belt co-operating with the second belt wound on the second roller; and means for increasing the speed of the second and third belts pinching the products relative to the speed of the first belt.

2. A device as claimed in claim 1, characterized in that the carriage is coupled to a shaft, said shaft being driven by a motor, so that the speed of the carriage is essentially the same as the speed of the first belt that causes the products arranged in a scale-fashion to be advanced.

3. A device according to claim 1, characterized in that during the displacement of carriage from the starting position to the final one, in which the products arranged in a scale fashion are separated, the length of the first, second and third belts remains unchanged.

4. A device according to claim 1, including a friction clutch on the shaft, characterized in that the speed of the second and third belts increases upon intervention of the friction clutch, said shaft being coupled with the pulleys of the first belt and with the pulleys of the third belt.

5. A device according to claim 1, including a ratcheting device which allows the rotational speed of the transmission assembly driving the second and third belts to be uncoupled when the speed increase of the same occurs.

6. A device according to claim 1, including means operable during the stroke of the carriage to effect a variation of the speed of the first belt.

7. A device according to claim 1, characterized in that separation of the scale is effected by reducing the speed of the first belt relative to the speed of the second and third belts.

* * * * *

UNITED STATES PATENT AND TRADEMARK OFFICE

CERTIFICATE OF CORRECTION

PATENT NO. : 6,945,531 B2
APPLICATION NO. : 10/275638
DATED : December 8, 2005
INVENTOR(S) : Aldo Perobelli It is certified that error appears in the above-identified patent and that said Letters Patent is hereby corrected as shown below:

The abstract should read as follows:

--A device for achieving the separation or extension of the overlap of superposed overlapping products during tranfer from upstream belt conveyor to a downstream belt conveyor. The device has drive pulleys that are capable of increasing the speed of the downstream belts (12, 17) conveying the separated or extended overlapping products relative to the speed of the upstream belt (11) of the device. The conveyors are spaced-apart and a movable carriage assists in the transfer of the products.--

The claims should read as folows:

--1. A device for obtaining a separation or extension of the overlap of superposed products, consisting of signatures, paper or paperboard sheets, folded boxes and the like, comprising an upstream conveyor having a first belt for products that are superposed in an overlapping fashion: a carriage movable along the path of said upstream conveyor and carrying at least two upstream pulleys, said pulleys positioning said first belt; a first roller on said carriage overlying said upstream conveyor for the retention of the overlapping products on said upstream conveyor; a downstream conveyor for the products spaced beyond the path of said the upstream conveyor, and composed of second and third belts both driven at the speed of upstream conveyor, a second roller on said carriage overlying said second belt of the downstream conveyor; means for adjusting the position of the first roller relative to the second roller according to the length of the products along the paths of said upstream and downstream conveyors; said carriage carrying at least two downstream pulleys, and at least a third pulley overlying said second belt; said second belt being wound on said at least two downstream pulleys; and said third belt being wound on said second roller and on said overlying pulley, and co-operating with said second belt to pinch the products between said second and third belts; and means for increasing the speed of said second and third belts relative to the speed of said first belt while said carriage is moved forward from a starting position to a final position.

2. A device according to claim 1, including a carriage shaft coupled to said carriage, and a motor driving and said shaft, so that the speed of the carriage is essentially the same as the speed of the upsteam conveyor.

UNITED STATES PATENT AND TRADEMARK OFFICE

CERTIFICATE OF CORRECTION

PATENT NO. : 6,945,531 B2
APPLICATION NO. : 10/275638
DATED : December 8, 2005
INVENTOR(S) : Aldo Perobelli It is certified that error appears in the above-identified patent and that said Letters Patent is hereby corrected as shown below:

3. A device according to claim 1, including drive pulleys for the second and third belts, a pulley shaft coupled with said drive pulleys and a friction clutch on said pulley shaft operable to increase the speed of the second and third belts upon actuation of the friction clutch.

4. A device according to claim 2, including drive pulleys for the second and third belts, a pulley shaft coupled with said drive pulleys and a friction clutch on said pulley shaft operable to increase the speed of the second and third belts upon actuation of the friction clutch, and a single motor driving said pulley shaft and said carriage shaft, and the three belts of said upstream and downstream conveyors, said pulley and carriage shafts constituting parts of a transmission assembly comprising at least five shafts, two clutches and six transmission belts.

5. A device according to claim 3, including a ratcheting device on said pulley shaft, said transmission assembly allowing the drive to the second and third belts to be uncoupled when their speed increases.

6. A device according to claim 1, including means operable during the motion of the carriage to effect a variation of the speed of the upstream conveyor.

7. A device according to claim 6, including means for effecting separation of the overlapping products by reducing the speed of the upstream conveyor relative to the speed of the downstream conveyor.--

Signed and Sealed this

Nineteenth Day of September, 2006

JON W. DUDAS
*Director of the United States Patent and Trademark Office*

UNITED STATES PATENT AND TRADEMARK OFFICE

CERTIFICATE OF CORRECTION

PATENT NO. : 6,945,531 B2
APPLICATION NO. : 10/275638
DATED : September 20, 2005
INVENTOR(S) : Aldo Perobelli It is certified that error appears in the above-identified patent and that said Letters Patent is hereby corrected as shown below:

The abstract should read as follows:

--A device for achieving the separation or extension of the overlap of superposed overlapping products during tranfer from upstream belt conveyor to a downstream belt conveyor. The device has drive pulleys that are capable of increasing the speed of the downstream belts (12, 17) conveying the separated or extended overlapping products relative to the speed of the upstream belt (11) of the device. The conveyors are spaced-apart and a movable carriage assists in the transfer of the products.--

The claims should read as follows:

--1. A device for obtaining a separation or extension of the overlap of superposed products, consisting of signatures, paper or paperboard sheets, folded boxes and the like, comprising an upstream conveyor having a first belt for products that are superposed in an overlapping fashion: a carriage movable along the path of said upstream conveyor and carrying at least two upstream pulleys, said pulleys positioning said first belt; a first roller on said carriage overlying said upstream conveyor for the retention of the overlapping products on said upstream conveyor; a downstream conveyor for the products spaced beyond the path of said the upstream conveyor, and composed of second and third belts both driven at the speed of upstream conveyor, a second roller on said carriage overlying said second belt of the downstream conveyor; means for adjusting the position of the first roller relative to the second roller according to the length of the products along the paths of said upstream and downstream conveyors; said carriage carrying at least two downstream pulleys, and at least a third pulley overlying said second belt; said second belt being wound on said at least two downstream pulleys; and said third belt being wound on said second roller and on said overlying pulley, and co-operating with said second belt to pinch the products between said second and third belts; and means for increasing the speed of said second and third belts relative to the speed of said first belt while said carriage is moved forward from a starting position to a final position.

2. A device according to claim 1, including a carriage shaft coupled to said carriage, and a motor driving and said shaft, so that the speed of the carriage is essentially the same as the speed of the upsteam conveyor.

UNITED STATES PATENT AND TRADEMARK OFFICE

CERTIFICATE OF CORRECTION

PATENT NO. : 6,945,531 B2
APPLICATION NO. : 10/275638
DATED : September 20, 2005
INVENTOR(S) : Aldo Perobelli It is certified that error appears in the above-identified patent and that said Letters Patent is hereby corrected as shown below:

3. A device according to claim 1, including drive pulleys for the second and third belts, a pulley shaft coupled with said drive pulleys and a friction clutch on said pulley shaft operable to increase the speed of the second and third belts upon actuation of the friction clutch.

4. A device according to claim 2, including drive pulleys for the second and third belts, a pulley shaft coupled with said drive pulleys and a friction clutch on said pulley shaft operable to increase the speed of the second and third belts upon actuation of the friction clutch, and a single motor driving said pulley shaft and said carriage shaft, and the three belts of said upstream and downstream conveyors, said pulley and carriage shafts constituting parts of a transmission assembly comprising at least five shafts, two clutches and six transmission belts.

5. A device according to claim 3, including a ratcheting device on said pulley shaft, said transmission assembly allowing the drive to the second and third belts to be uncoupled when their speed increases.

6. A device according to claim 1, including means operable during the motion of the carriage to effect a variation of the speed of the upstream conveyor.

7. A device according to claim 6, including means for effecting separation of the overlapping products by reducing the speed of the upstream conveyor relative to the speed of the downstream conveyor.--

This certificate supersedes Certificate of Correction issued September 19, 2006.

Signed and Sealed this

Fourteenth Day of November, 2006

JON W. DUDAS
*Director of the United States Patent and Trademark Office*